US006482561B1

(12) United States Patent
Arai et al.

(10) Patent No.: US 6,482,561 B1
(45) Date of Patent: Nov. 19, 2002

(54) TONER USED FOR DEVELOPING ELECTROSTATIC LATENT IMAGE

(75) Inventors: Takeshi Arai, Akashi (JP); Megumi Aoki, Itami (JP); Yoshitaka Sekiguchi, Nishinomiya (JP); Junichi Tamaoki, Sakai (JP); Yoshihiro Mikuriya, Nishinomiya (JP); Tetsuo Sano, Amagasaki (JP); Masayuki Hagi, Minou (JP); Kenichi Kido, Nishinomiya (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/645,544

(22) Filed: Aug. 25, 2000

(30) Foreign Application Priority Data

Aug. 27, 1999 (JP) ..... 11-241359

(51) Int. Cl.[7] ..... G03G 9/087

(52) U.S. Cl. ..... 430/108.1; 430/108.8; 430/109.4; 430/111.4

(58) Field of Search ..... 430/109.4, 111.4, 430/109.1, 108.8, 108.1

(56) References Cited

U.S. PATENT DOCUMENTS

| | | | | | |
|---|---|---|---|---|---|
| 5,523,190 | A | * | 6/1996 | Hosono | 430/124 |
| 5,707,771 | A | | 1/1998 | Matsunaga | 430/110 |
| 5,753,399 | A | | 5/1998 | Hayase et al. | 430/109 |
| 5,766,816 | A | | 6/1998 | Nagase et al. | 430/124 |
| 5,773,183 | A | * | 6/1998 | Duojo et al. | 430/106 |
| 5,840,457 | A | | 11/1998 | Urawa et al. | 430/45 |
| 5,863,694 | A | * | 1/1999 | Sano et al. | 430/109 |
| 6,002,903 | A | | 12/1999 | Hayase et al. | 399/279 |
| 6,022,659 | A | * | 2/2000 | Kanbayashi et al. | 430/106 |
| 6,040,104 | A | * | 3/2000 | Nakamura et al. | 430/111 |

FOREIGN PATENT DOCUMENTS

| | | | | |
|---|---|---|---|---|
| JP | 5-142963 | | 6/1993 | |
| JP | 07261459 | A * | 10/1995 | 430/109.4 |
| JP | 8-101530 | | 4/1996 | |
| JP | 8-334930 | | 12/1996 | |

OTHER PUBLICATIONS

Machine translation of JP 7–261459 (1995).*

* cited by examiner

*Primary Examiner*—Christopher Rodee
(74) *Attorney, Agent, or Firm*—Burns, Doane, Swecker & Mathis, LLP

(57) ABSTRACT

The present invention relates to a toner that contains at least a binder resin and a colorant, characterized in that the toner has a temperature range of 90 to 110° C. at $2\times10^3$ (Pa) of a storage elastic modulus (G') under 0.1 (Hz) of a frequency.

22 Claims, No Drawings

TONER USED FOR DEVELOPING ELECTROSTATIC LATENT IMAGE

This application is based on application No. 241359/1999 filed in Japan, the contents of which are hereby incorporated by reference.

BACKGROUND OF THE INVENTION

1. Field of the Invention

The present invention relates to a toner used for developing electrostatic latent images in an image-forming method such as an electrophotographic method, an electrostatic recording method and an electrostatic printing method, and more specifically concerns a toner preferably used for developing electrostatic latent images in a full-color image-forming apparatus such as a full-color electrostatic copying machine and a full-color laser beam printer.

2. Description of the Related Art

In the case of a full-color image-forming system using the electrophotographic method, since a full-color image is obtained by superposing toner images of magenta toner, cyan toner and yellow toner, it is one of the greatest requirements for the toner to have sharply-melting properties so as to allow the toner layers of the respective colors to melt instantaneously by heat, to be able to be mixed easily and to allow for clear color developments, at the time of fixing (U.S. Pat. Nos. 4,142,982, 4,590,139); however, toners of this type have a high viscosity, low elasticity and a small particle-to-particle aggregating force at the time when the toner is thermally fused, resulting in a problem of off-set with the heating roller (particularly, at the time of high temperatures). Such a problem becomes conspicuous especially when there is degradation in the roller due to repetitive use and when an image having a large amount of toner or a large toner adhering area (for example, a photograph image) on a toner recording material (such as paper). For this reason, in order to additionally improve the anti-off-set property at high-temperatures, mold-releasing oil, such as silicone oil, has to be applied to the fixing roller; however, this causes another problem of too much luster caused by the oil.

In recent years, as full-color printers and copying machines with high image quality have come to be widely used, the number of output sheets of color images have increased drastically, and there have been increasing demands for high speed operations and toners that are less susceptible to changes in image luster at the time of continuous copying processes. Great variations in luster tend to make the same color look different, and variations in luster give great influences on hues and color reproducibility sensed by the human eye.

However, in the case when a conventional toner that puts an emphasis on the sharp melting properties is used, there is a problem in which the image luster changes greatly at the time of continuous copying processes. This problem becomes more conspicuous when the copying speed becomes faster. It is considered that the variations in luster occur due to a reduction in the fixing roller temperature that gradually takes place as paper takes heat from the surface of the fixing roller. Moreover, when, after continuous copying processes have been carried out by using A-4 paper longitudinally, the change to a lateral A-4 copying process leads to variations in luster occurring in an image on a single sheet, resulting in another problem. More specifically, when A-4 paper is used longitudinally, portions on both ends of the fixing roller do not contribute to the fixing process, while in the case when A-4 paper is used laterally, not only the center portion of the fixing roller, but also both ends of the fixing roller, contribute to the fixing process, with the result that a temperature difference occurs between the center portion and both ends of the fixing roller at the time of copying, thereby causing portions with high luster and other portions with low luster. Such problems of variations in luster at the time of continuous copying processes and variations in luster on one copied image become more conspicuous in the case of the processes at cold places and immediately after power application.

The following patent applications have disclosed techniques in which the viscoelasticity of a toner or a resin used therewith has been taken into consideration: for example, Japanese Patent Laid-Open No. Hei 5-142963, Japanese Patent Laid-Open No. 8-101530, U.S. Pat. No. 5,707,771, Japanese Patent Laid-Open No. 8-334930, U.S. Pat. Nos. 5,753,399, 6,002,903, 5,766,816 and 5,840,457.

However, some of these techniques fail to properly find a state at the time of paper separation in which the luster is actually determined due to the fact that the viscoelasticity-measuring temperature is too high, or some of them fail to provide an image with proper luster since the specified value is too high. In other words, any of the toners in the above-mentioned techniques fail to provide an image with proper luster when the fixing roller temperature varies or any temperature difference occurs in the fixing roller due to variations in ambient conditions or continuous copying processes for many copies.

SUMMARY OF THE INVENTION

The present invention is to provide an electrostatic-image developing toner which can provide an image with proper luster even when the fixing roller temperature varies or any temperature difference occurs in the fixing roller due to variations in ambient conditions or continuous copying processes for many copies, and which also has superior anti-offset properties.

Another objective of the present invention is to provide an electrostatic-image developing toner which is also superior in the low-temperature fixing properties and the anti-blocking properties.

The above objects can be achieved by a toner comprising:

a first binder resin and a colorant;

wherein the toner has a temperature range of 90 to 110° C. at $2\times10^3$ (Pa) of a storage elastic modulus (G') under 0.1 (Hz) of a frequency.

DETAILED DESCRIPTION OF THE INVENTION

The present invention provides a toner comprising:

a first binder resin and a colorant;

wherein the toner has a temperature range of 90 to 110° C. at $2\times10^3$ (Pa) of a storage elastic modulus (G') under 0.1 (Hz) of a frequency.

The inventors of the present invention have focused their attention to the toner behavior upon fixing toner on a recording material (more specifically, at the time when toner (image) is separated from the fixing roller upon fixing the toner on the recording material by using the fixing roller), and have found that the luster of an image depends on the smoothness of the surface of the image, that the smoothness of the surface of the image depends on the adhering force exerted between the surface of the image and the fixing roller, that the adhering force depends on the behavior of the toner (elastic characteristic) as an elastic member, that when the storage elastic modulus (hereinafter, referred to simply as "G' "), which serves as an index for the corresponding elastic characteristic, is set at $2\times10^3$ (Pa), the surface state (smoothness) of an image has an optimum image luster (degree of luster from 15 to 40), and that the temperature at this time is located in a specific temperature range, an image having a superior luster is obtained through a low-temperature fixing process even when the temperature of the fixing roller is varied.

More specifically, in the case when the smoothness of the image surface is too low, the incident light is diffused due to fine irregularities of the surface, with the result that the luster becomes insufficient, and in the case when the smoothness of the image surface is too high, the incident light has an excessively high and strong reflectivity (which gives too much gloss to the entire image). Moreover, when the adhesive strength between the image and the contact face of the fixing roller is too small, the smoothness becomes higher since the image is easily separated, and when the adhesive strength is great, the separation is difficult, with the result that scratch lines appear on the separation surface and the smoothness becomes low due to the resulting irregularities on the image surface. Moreover, the adhesive strength between the image surface and the fixing roller is determined by the wettability and affinity between the two as well as the balance of the recovering strength (elastic characteristic) caused by the elastic repulsive force of the toner layer. The adhesive strength is highly dependent on the recovering strength caused by the elastic repulsive force of the toner layer.

The toner of the present invention is designed so that the temperature range that allows the storage elastic modulus (G') to have $2\times10^3$ (Pa) when the frequency is 0.1 (Hz) is set from 90 to 110° C., preferably from 95 to 110° C. When the temperature is less than 90° C., the luster of the resulting image becomes too high, giving too much gloss to the image, as well as causing toner adhesion to the fixing roller, resulting in a phenomenon in which the adhering toner again adheres to the recording material such as paper (hereinafter, referred to as "off-set") at comparatively high fixing temperatures. In contrast, when the above-mentioned temperature exceeds 110° C., the luster of the resulting image becomes insufficient, the off-set occurs at comparatively low fixing temperatures, and the fixing strength of the resulting image to the recording material becomes too low, making it easy to separate the image. In this manner, in the present invention, the temperature range that allows the storage elastic modulus (G') to have $2\times10^3$ (Pa) when the frequency is 0.1 (Hz) is controlled to a specific temperature range that is comparatively low so that it is possible to provide an image with proper luster even when the fixing roller temperature varies or any temperature difference occurs in the fixing roller due to variations in ambient conditions or continuous copying processes for many copies, to improve anti-off-set properties, and consequently to reduce the amount of the application of the oil to the roller at the time of the fixing process, as well as enabling a fixing process at low temperature. Moreover, the toner of the present invention is superior in the heat resistant properties so that it is possible to avoid aggregation even at the shelf time at high temperatures (anti-blocking properties).

In the present specification, the storage elastic modulus (G') indicates the elasticity term in the viscoelastic function of a substance, and is an index that shows the degree of elasticity of the substance. The greater the value of G', the stronger the tendency of the measured substance to behave as an elastic material; in contrast, the smaller the value of G', the stronger the tendency of the measured substance to behave as a viscous material. Moreover, with respect to the temperature at which the storage elastic modulus (G') at a frequency of 0.1 (Hz) becomes $2\times10^3$ (Pa), values measured by using a viscoelasticity measuring device (Rheometer; Stresstech type, DynAlyser® DAR-100; made by Reo-Logica Corp.) were adopted.

Measuring tool; parallel plate having diameter 20 mm

Measuring frequency; 0.1 Hz

Measured distortion; Max 5%

Measuring temperature; raised from 60°C. to 200° C. at a ratio of 2° C. per min.

More specifically, first, the toner is put on a lower plate maintained at 130° C., and after this state was maintained for five minutes so as to sufficiently fuse the toner, an upper plate is placed so as to set the thickness of the toner at 1.0 mm, and excessive toner was removed, and this is cooled to room temperature. After the cooling process, the variation of G' in response to the temperature is followed under the above-mentioned conditions so that the temperature at which G' has a value of $2\times10^3$ (Pa) is obtained. G' does not depend on the material, surface precision, etc. of the plate.

Moreover, the toner of the present invention has small temperature dependence in the degree of luster within a range of the degree of image luster that is considered to be appropriate. In other words, in the toner of the present invention, the width of fixing temperatures that exhibit a degree of luster in the range of 15 to 40 is not less than 15° C., preferably not less than 20° C. In this manner, since the width of the fixing temperatures exhibiting the range of the appropriate degree of luster is wide, it is possible to provide an image with proper luster even when the fixing roller temperature varies or any temperature difference occurs in the fixing roller due to variations in ambient conditions or continuous copying processes for many copies. The problems with variations in luster of an image are considered to occur because of the fact that the temperature dependence in the degree of luster within a range of the degree of image luster that is considered to be appropriate is so high that the degree of image luster deviates from the appropriate range due to variations in the temperature of the fixing roller. In general, as the fixing temperature rises, the resulting degree of image luster increases.

In the present specification, with respect to the degree of image luster, values measured by a luster meter (GM-060; made by Minolta K.K.) were adopted; however, the above-mentioned device is not necessarily used. The range of the luster degree that is considered to be appropriate differs depending on a measuring device; therefore, when another measuring device is used, the width of the fixing temperatures exhibiting an appropriate range in the degree of luster in the corresponding measuring device is preferably set so as to be maintained in the above-mentioned range.

The toner of the present invention contains, at least, a first binder resin and a colorant, and may contain a mold-releasing agent, a charge-control agent and other agents, if necessary.

With respect to the binder resin constituting the toner of the present invention, any conventionally known resin in the field of electrophotography may be used as long as the toner as described above is obtained; and, for example, polyester resin, polystyrene resin, vinyl resin, epoxy resin, polyether-polyol resin, etc. may be used.

With respect to the binder resin, it is preferable to use two kinds of resins (first binder resin: low molecular weight material, second binder resin: high molecular weight having different molecular weights. More specifically, a first binder resin having a number-average molecular weight (Mn) in the range of 2,000 to 8,000, preferably 2,500 to 6,000, more preferably 3,000 to 6,000, and a weight-average molecular weight (Mw) in the range of 7,000 to 30,000, preferably 8,000 to 25,000, more preferably 9,000 to 20,000, and a second binder resin having an Mn in the range of 3,000 to 12,000, preferably 4,000 to 10,000, more preferably, 4,000 to 7,000, and an Mw in the range of 30,000 to 250,000, preferably 40,000 to 250,000, more preferably 40,000 to 100,000, are used in combination. In this case, it is preferable for the two first and second binder resins to have a compatibility with each other. The application of the first binder resin is preferable from the viewpoint of toner-preserving properties at high temperatures (anti-blocking properties), the fixing strength of the toner to the recording material and the resin strength, and the application of the second binder resin is preferable from the view point of the reducing effect on the luster variation to the temperature variations, the anti-high-temperature off-set at the time of fixing and the fixing strength of the toner to the recording material.

With respect to the number-average molecular weight (n) and the weight-average molecular weight (Mw), measurements were made by using a gel permeation chromatography (GPC) (807-IT Type: Nippon Bunko Kogyo K.K.) in which: 1 kg/cm$^2$ of tetrahydrofuran was flowed as a solvent while the column was maintained at 40° C., and 30 mg of a sample to be measured was dissolved in 20 ml of tetrahydrofuran, and then, 0.5 mg of this solution was introduced together with the carrier solvent; thus these molecular weights were measured based upon polystyrene conversion.

In the present invention, the first binder resin has a softening point (Tm) in the range of 75° C. to 130° C., preferably 80° C. to 125° C., more preferably 85° C. to 115° C., and a glass transition temperature (Tg) in the range of 45° C. to 85° C., preferably 50° C. to 80° C., more preferably 55° C. to 75° C.; these temperature ranges are preferable from the viewpoint of the anti-blocking properties of the toner, the fixing strength of the toner to the recording material and the color mixing properties (color reproducibility) of respective toners. The second binder resin has a Tm in the range of 105° C. to 155° C., preferably 110° C. to 150° C., more preferably 110° C. to 135° C., and a Tg in the range of 55° C. to 85° C., preferably 60° C. to 85° C., more preferably 60° C. to 75° C.; thus, these temperature ranges are preferable from the view point of the reducing effect on the luster variation to the temperature variations, the anti-high-temperature off-set at the time of fixing and the fixing strength of the toner to the recording material.

In the present specification, the softening point (Tm) of resins was measured by the following method. A sample to be measured (1.0 g) was weighed, and a flow tester (CFT-500: made by Shimadzu K.K.) was used in which: measurements were made under conditions of the application of a die having a size of h 1.0 mm×φ1.0 mm, a temperature rise rate of 3.0° C./min, a pre-heating time of 180 seconds, a load of 30 kg, and a measuring temperature range of 60 to 160° C., and the temperature at the time of the 1/2 flow of the above-mentioned sample was defined as the softening point (Tm).

The glass transition point (Tg) of resins was measured by the following method. A differential scanning calorimeter (DSC-200: made by Seiko Instrument K.K.) was used in which: 10 mg of a sample to be measured was precisely weighed, and this was put into an aluminum pan, while α-alumina was put into an aluminum pan so as to be used as reference, and was heated to 200° C. from normal temperature at a temperature-rise rate of 30° C./min, and this was then cooled, and subjected to measurements in the range of 20° C. to 120° C. at a temperature-rise rate of 10° C/min; thus, during this temperature-rise process, the shoulder value of the main heat-absorption peak in the range of 30° C. to 90° C. was defined as the glass transition point Tg.

When the above-mentioned first binder resin and the second binder resin are used as the binder resins, the weight ratio (A:B) of the first binder resin and the second binder resin is set in the range of 5:95 to 95:5, preferably 20:80 to 95:5, more preferably 60:40 to 90:10; this setting is preferable from the viewpoint of the toner fixing properties at low temperatures, the reducing effect on the luster variation to the temperature variations and the anti-high-temperature off-set at the time of fixing.

In the present invention, it is preferable to use polyester resins as the above-mentioned first binder resin and the second binder resin. More specifically, monomers constituting the polyester resins of the first binder resin and the second binder resin are not particularly limited; and any of known acid monomers and alcohol monomers may be used.

With respect to the acid monomers, not particularly limited as long as they contain not less than two carboxylic groups, the following monomers are, for example, listed: fumaric acid, maleic acid, maleic anhydride, phthalic acid, terephthalic acid, isophthalic acid, malonic acid, succinic acid, glutaric acid, dodecenyl succinic anhydride, n-octyl succinic acid, n-dodecyl succinic acid, 1,2,4-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methyl-2-methylenecarboxylpropane, tetra(methylenecarboxy) methane, 1,2,7,8-octanetetracarboxylic acid, trimellitic anhydride, trimellitic acid, pyromellitic acid, pyromellitic anhydride, and low alkyl esters of these acids. Among these, preferable acid monomers include, for example, fumaric acid, terephthalic acid, trimellitic anhydride, succinic acid, etc. Not less than two kinds of acid monomers may be used in combination.

With respect to alcohol monomers, not particularly limited as long as they contain not less than two hydroxyl groups, the following monomers are, for example, listed: ethylene glycol, propylene glycol, 1,4-butanediol, 2,3-butanediol, diethylene glycol, triethylene glycol, 1,5-pentanediol, 1,6-hexanediol, neopentene glycol, 1,4-cyclohexanedimethanol, dipropylene glycol, polyethylene glycol, polypropylene glycol, bisphenol A and derivatives thereof, hydrogenised bisphenol A, glycerin, sorbitol, 1,4-sorbitan, trimethylolpropane, etc. Among these, preferable alcohol monomers include bisphenol A derivatives, in particular, polyoxypropylene (2.2)-2,2-bis(4-hydroxyphenyl)propane, polyoxyethylene (2.0)-2,2-bis(4-hydroxyphenyl)propane, etc.

With respect to monomers constituting the second binder resin in the present invention, trivalent or more monomers (including acid monomers and alcohol monomers) are used, preferably, at a rate of 3 to 50 mole %, more preferably 5 to 25 mole %, with respect to all the monomers constituting the resin. With respect to trivalent or more monomers, it is preferable to use trivalent acid monomers from the viewpoint of costs. In the case of preparation of a negatively chargeable toner, it is advantageous to use trivalent acid monomers from the viewpoint of chargeability. With respect to the trivalent acid monomers, among the above-mentioned compounds exemplified as acid monomers, those compounds having three carboxylic groups are preferably used.

In particular, the preferable first polyester resin is a linear polyester resin formed of a divalent acid monomer and a divalent alcohol monomer. The preferable second polyester resin is a non-linear polyester resin formed of a divalent acid monomer, a trivalent acid monomer and a divalent alcohol monomer.

In the present invention, upon the application of the first binder resin and the second binder resin as the binder resins, another resin different from the first binder resin and the second binder resin may be mixed therewith. With respect to another resin, not particularly limited as long as it has a compatibility with the first binder resin and the second binder resin, any of the above-mentioned resins exemplified as the binder resin may be used. An amount of use of this resin is preferably set to not more than 10% by weight with respect to the mixed binder resin formed of the first binder resin, the second binder resin and this resin.

In the binder resin of the present invention, from the viewpoint of the light-transmitting properties of the toner for OHP, the low-temperature fixing properties and the pulverizing properties of the resin, the insoluble content of tetrahydrofuran (hereinafter, referred to as THF insoluble content) is preferably set at not more than 5% by weight. In the binder resin of the present invention, the smaller the THF insoluble content, the better; and it is most preferable to set it to 0% by weight. In the present specification, the THF insoluble content is an insoluble content (% by weight) remaining on filter paper (No. 5B made by Advantech Co., Ltd.) when a sample (2.0 g) is dissolved in THF (250 ml) at normal temperature, and allowed to stand.

With respect to colorants contained in the toner of the present invention, not particularly limited, conventionally known pigments and dyes in the field of electrophotography may be used. Examples of them include carbon black, aniline blue, Chalco Oil Blue, chrome yellow, ultramarine blue, DuPont Oil Red, quinoline yellow, methylene blue chloride, copper phthalocyanine, Malachite green oxalate, Lump Black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Blue 15:1, C.I. Pigment Blue 15:3, etc.

The content of the colorants is not particularly limited; and, in general, it is preferably set to 2 to 10 parts by weight with respect to 100 parts by weight of the binder resin.

In the present invention, from the viewpoint of the dispersing properties of the colorant in the toner particles, it is preferable to preliminarily disperse the colorants in a resin having compatibility with the binder resin to be used so as to form a master batch. More specifically, a resin that has compatibility with the binder resin to be used is mixed therewith preferably at a weight ratio of the first binder resin and the colorant (resin/colorant) of approximately 100/15 to 100/50. After melted and kneaded, the mixture is cooled and pulverized to give a master batch. The master batch having passed through a mesh of 0.5 to 4.0 mm is preferably used, and the amount of use is set so as to contain the amount of the colorant that is maintained in the above-mentioned range.

A desired mold-releasing agent, charge-control agent, etc. may be properly incorporated with the toner of the present invention.

The mold-releasing agent is not particularly limited, and examples thereof include: polyethylene wax, oxdized-type polyethylene wax, polypropylene wax, oxdized-type polypropylene wax, carnauba wax, sazol wax, rice wax, candelilla wax, jojoba oil wax, beeswax, etc. A content of the mold-releasing agent is not particularly limited; and in general, it is preferably set in the range of 0.5 to 7 parts by weight with respect to 100 parts by weight of the binder resin.

To the toner of the present invention, a charge-control agent may be added on demand so as to further stabilize its chargeability. With respect to the charge-control agent, not particularly limited, generally known negative charge control agents that control the toner to have negative chargeabllity may be used. Examples thereof include: a metal complex of derivatives of salicylic acid, a calix arene compound, an organic boron compound, a fluorine-containing quaternary ammonium salt compound, a monoazo metal complex, an aromatic hydroxycarboxylic acid-based metal complex, an aromatic dicarboxylic acid-based metal complex, etc. Among these materials, those having no color (white color) are preferably used for color toners. A content of the charge-control agent is not particularly limited; and in general, it is preferably set in the range of 0.5 to 5 parts by weight with respect to 100 parts by weight of the binder resin.

With respect to the magnetic particles, iron particles, iron oxide particles, ferrite, nickel, etc. may be used. A content of the magnetic particles is not particularly limited; and in general, it is preferably set in the range of 0.5 to 10 parts by weight with respect to 100 parts by weight of the binder resin.

The toner of the present invention may be prepared by using a conventionally known method, for example, a pulverizing method, an emulsion dispersing granulation method, etc. From the viewpoint of the easiness in production and the productivity, it is preferable to adopt the pulverizing method. In the case of the application of the pulverizing method, the toner of the present invention is obtained, for example, in the following processes: The above-mentioned first binder resin and the colorant, and if necessary, the mold-releasing agent and the charge-control agent, are mixed together, and the mixture is fused and kneaded, and then cooled, coarsely pulverized, finely ground, and classified to obtain the toner. The resulting toner of the present invention is preferably controlled to have a volume-average particle size of 4 to 10 $\mu$m.

Moreover, to the toner of the present invention, an externally additive agent and a cleaning-assist agent may be added and mixed. With respect to the externally additive agent, examples thereof include: silica fine particles, titanium dioxide fine particles, alumina fine particles, magnesium fluoride fine particles, silicon carbide fine particles, boron carbide fine particles, titanium carbide fine particles, zirconium carbide fine particles, boron nitride fine particles, titanium nitride fine particles, zirconium nitride fine particles, magnetite fine particles, molybdenum disulfide fine particles, aluminum stearate fine particles, magnesium stearate fine particles, zinc stearate fine particles, etc. These fine particles are preferably subjected to a hydrophobicizing process by using an agent, such as a silane coupling agent, a titanium coupling agent, a higher fatty acid and a silicone oil. A amount of use of the externally additive agent is preferably set in the range of 0.1 to 3.0% by weight.

Mith respect to the cleaning-assist agent, various kinds of organic fine particles, such as styrenic fine particles, acrylic fine particles, methacrylic fine particles, benzoguanamine, silicone, Teflon, polyethylene and polypropylene, which have been granulated by using a wet-type polymerization method, such as emulsion polymerization, soap-free emulsion polymerization and nonaqueous dispersion polymerization, or a gaseous phase method. These organic fine particles may be used alone, or may be used in combination with the externally additive agent.

The toner of the present invention can be applied to both of a one-component developer that does not use a carrier and a two-component developer that is used together with a carrier; however, it is preferable to apply it to the two-component developer. With respect to the carrier used together with the toner of the present invention, any of known carriers may be used: Examples thereof include:

carriers made of magnetic particles such as iron particles and ferrite, coat-type carriers formed by coating the surface of magnetic particles with a coating agent such as a resin, and dispersion-type carriers formed by dispersing magnetic fine particles in a binder resin. Any of these carriers may be used. Carriers preferably used in the present invention have an average particle size of 20 to 70 μm, preferably 30 to 60 μm.

The following description will discuss the present invention in more detail by means of examples; however, the present invention is not intended to be limited thereby.

EXAMPLES (Preparation of binder resin)

First binder resin (low molecular material) and second binder resin (high molecular material), shown in Table 1 and Table 2, which were used as binder resins for toners of Examples and Comparative Examples, were prepared as described below: Polyoxypropylene (2.2)-2,2-bis(4-hydroxyphenyl)propane (hereinafter, referred to simply as BPA-PO) and polyoxyethylene(2.0)-2,2-bis(4-hydroxyphenyl)propane (hereinafter, referred to simply as BPA-EO) were used as alcohol monomer components, and terephthalic acid (hereinafter, referred to simply as TPA), fumaric acid (hereinafter, referred to simply as FA) and trimellitic anhydride (hereinafter, referred to simply as TMA) were used as acid monomer components.

More specifically, the respective monomers were weighed so as to have mole ratios of the monomers as shown in Table 1 and Table 2. These monomers were put into a four-necked flask of 2 liters with a reflux condenser, a water-separation device, a nitrogen gas-introducing tube, a thermometer and a stirring device. These monomers were stirred and allowed to react while being heated on a mantle heater with nitrogen being introduced into the flask through the nitrogen gas-introducing tube. At this time, the reaction temperature was set in the range of 180° C. to 240° C. During the reaction, the reaction state was followed while the acid value was being measured; thus, the respective reactions were completed at the time when predetermined acid values had been reached to give first binder resins A-1 to A-5 and second binder resins B-1 to B-6. The reaction time was 5 to 10 hours.

The number-average molecular weight (Mn), the weight-average molecular weight (Mw), the glass transition point (Tg), the softening point (Tm) and the THF insoluble content (% by weight) were measured on the resulting resin. The results are shown in Table 1 and Table 2 together with the monomer composition ratios (mole ratios) of the respective resins.

TABLE 1

| First binder resin <Low molecular material> | | | | | | | | | |
|---|---|---|---|---|---|---|---|---|---|
| | Monomer composition ratio | | | | Resin physical properties | | | | |
| | Acid monomer | | Alcohol monomer | | Molecular weight distribution | | Thermal properties | | THF insoluble content |
| Kinds | FA | TPA | BPA-EO | BPA-PO | Mn | Mw | Tg (° C.) | Tm (° C.) | |
| A-1 | 5 | 4 | 2 | 9 | 4500 | 13600 | 59.5 | 97.6 | 0 |
| A-2 | 8 | 1 | 8 | 3 | 2700 | 8800 | 50.5 | 82.8 | 0 |
| A-3 | 3 | 6 | 1 | 10 | 5900 | 23000 | 71.0 | 122.5 | 0 |
| A-4 | 7 | 2 | 8 | 3 | 2400 | 7900 | 47.0 | 78.5 | 0 |
| A-5 | 4.5 | 4.5 | — | 11 | 7500 | 26300 | 69.1 | 126.6 | 0 |

TABLE 2

| Second binder resin <High molecular material> | | | | | | | | | |
|---|---|---|---|---|---|---|---|---|---|
| | Monomer composition ratio | | | | Resin physical properties | | | | |
| | Acid monomer | Alcohol monomer | | Trivalent or more | Molecular weight distribution | | Thermal properties | | THF insoluble content |
| Kinds | TPA | BPA-EO | BPA-PO | TMA | Mn | Mw | Tg (° C.) | Tm (° C.) | |
| B-1 | 7 | 3 | 7 | 2 | 5400 | 79200 | 66.0 | 119.9 | 0 |
| B-2 | 8 | 5 | 4 | 1 | 4200 | 54000 | 65.1 | 117.4 | 0 |
| B-3 | 6 | 1.5 | 8.5 | 3 | 9800 | 194000 | 77.7 | 147.8 | 0 |
| B-4 | 8 | 6 | 4 | 1 | 3200 | 39000 | 60.6 | 118.4 | 0 |
| B-5 | 7 | 9 | 1 | 2 | 4100 | 42500 | 59.2 | 109.4 | 0 |
| B-6 | 6 | 1 | 9 | 3 | 11400 | 216000 | 77.5 | 152.3 | 7.2 |

Examples and Comparative Examples

Upon preparing the toners of Examples 1 to 12 and Comparative Examples 1 and 2, the binder resin was prepared by drive-blending first binder resin and second binder resin shown in Table 3 at each of the weight ratios as shown in Table 3 in Henschel mixer.

In the respective Examples and Comparative Examples, the respective binder resins, used in Examples and Comparative Examples, were mixed with a cyan colorant (C.I. Pigment Blue 15-3: made by Toyo Ink Seizou K.K.) at a ratio of 7:3 (weight ratio), and kneaded in a pressure kneader. The resulting kneaded material was pulverized in a feather mill to give respective master batches.

The above-mentioned binder resin (93 parts by weight), 10 parts by weight of the pigment master batch and 2 parts by weight of polypropylene wax (100-TS; made by Sanyo Kasei Kogyo K.K.) were mixed in Henschel mixer, and the mixture was kneaded by a twin-screw extruder kneader. Then, after the kneaded material thus kneaded had been cooled off, the kneaded material was coarsely pulverized in a feather mill, finely pulverized in a jet mill, and classified to give toner particles having a volume-average particle size of 7.8 $\mu$m. To the resulting toner particles were added 0.8% by weight of hydrophobic silica (H2000; made by Clariant K.K.) as an externally additive agent and 1.0% by weight of hydrophobic titania A having a degree of hydrophobicity of 60%, manufactured as will be described below. The mixture was mixed in Henschel mixer to give toners of Examples 1 to 12 and Comparative Examples of 1 and 2.

(Preparation of hydrophobic titania A)

To titania (STT-30; made by Titan Kogyo K.K.) having a primary particle size of 50 nm was added and mixed n-hexyltrimethoxysilane while being mixed and stirred in an aqueous system so as to set at 20% by weight of titania based upon solid component conversion; and this was then dried and pulverized to give hydrophobic titania A having a degree of hydrophobicity of 60%.

As a carrier to be mixed with the above-mentioned toner, a resin-coated carrier was used, which was prepared as follows:

(Preparation method of carrier)

First, to a measuring flask of 500 ml provided with a stirring device, a condenser, a thermometer, a nitrogen-introducing tube and a dripping device was added 100 parts by weight of methyl ethyl ketone. Sepatately, to 100 parts by weight of methyl ethyl ketone were added and dissolved 36.7 parts by weight of methyl methacrylate, 5.1 parts by weight of 2-hydroxyethyl methacrylate, 58.2 parts by weight of 3-methacryloxypropyltris(trimethylsiloxy)silane and 1 part by weight of 1,1'-azobis (cyclohexane-1-carbonitrile) at 80° C. under a nitrogen atmosphere to prepare a solution, and this solution was dripped into the above-mentioned flask for two hours and matured for five hours to obtain a resin. Then, to the resulting resin was added an isophoronediisocyanate/trimethylolpropane adduct (IPDI/TMP series: NCO% =6.1%) as a cross-linking agent, so as to adjust the OH/NCO mole ratio to 1/1, and this was diluted by methyl ethyl ketone so that a coat resin solution having a solid component ratio of 3% by weight. By using calcined ferrite particles F-300(made by Powdertech K.K.) having an average particle size of 50 $\mu$m as a core material, the coat resin solution was applied thereto and dried by Spira Cota (made by Okada Seiko K.K.) so that an amount of coated resin to the core material is set at 1.5% by weight. The resultant carrier was left in a hot-air circulating oven for one hour at 160° C. so as to be cured. After having been cooled off, the ferrite particle bulk was pulverized by using a sieve shaker having screen meshes having openings of 106 $\mu$m and 75 $\mu$m to give a resin-coated carrier.

To 6 parts by weight of each of the resulting toners was added and mixed 94 parts by weight of the resin coated carrier so as to form a starter. The starter was used so as to make following evaluations.

(Measuring method of the degree of image luster)

Measurements on the degree of luster were carried out by using a commercially available full-color copying machine (CF-900; made by Minolta K.K.) in which a solid image of 1.5 cm×1.5 cm (with the amount of adhesion of 2.0 mg/cm$^2$) was used so as to measure the degree of luster from the image while the image-fixing temperature was changed by 3° C. within a range from 122° C. to 170° C.

Evaluation method (Appropriate luster generation temperature)

Evaluation was made on the degree of luster on the basis of the temperature at which the lowermost value of 15 of appropriate luster was obtained. When the temperature was less than 145° C., the evaluation was ranked as ◎, when this was in the range from not less than 145° C. to less than 150° C., the evaluation was ranked as ○, when this was in the range from not less than 150° C. to less than 155° C., the evaluation was ranked as Δ (without any problem in practical use), and when this was not less than 155° C., the was ranked as X (with problems in practical use).

(Width of the appropriate luster generation temperatures)

Evaluation was made on the basis of a temperature width obtained by subtracting the temperature at which the degree of luster of 15 was obtained from the temperature at which the degree of luster of 40 was obtained. Since the degree of luster in which luster of an image appeared to be favorable was in the range of 15 to 40, the wider the width of temperatures satisfying the range, the smaller the variation in the image luster even upon variations in the fixing roller temperature, that is, the smaller the temperature dependence of the degree of luster within the above-mentioned range of the degree of luster. When the temperature width was not less than 20° C., the evaluation was ranked as ◎, when this was in the range from less than 20° C. to not less than 15° C., the evaluation was ranked as ○, when this was less than 15° C., the evaluation was made as X (with problems in practical use).

(Lowermost fixing temperature)

Solid images of 1.5 cm×1.5 cm (with the amount of adhesion of 2.0 mg/cm$^2$) were copied by a commercially available full-color copying machine (CF-900; made by Minolta K.K.) while the image-fixing temperature was changed by 2° C. within a range from 120° C. to 170° C. Each copied image was bent into two portions in the middle, and the separation properties of the image were visually observed. The lowermost fixing temperature was defined from temperatures between the fixing temperature at which the image was slightly separated and the lowermost fixing temperature at which no separation occurred. When the fixing lowermost temperature was less than 142° C., the evaluation was ranked as ◎, when this was in the range from not less than 142° C. to less than 146° C., the evaluation was ranked as ○, when this was in the range from not less than 146° C. to less than 152° C., the evaluation was ranked as Δ (without any problem in practical use), and when this was not less than 52° C., the evaluation was ranked as X (with problems in practical use).

(High-temperature off-set)

Halftone images were copied by a commercially available full-color copying machine (CF-900; made by Minolta K.K.) with the fixing system speed being set at 1/2 while the fixing temperature was changed by 5° within a range from 130° C. to 190° C. Thus, these images were visually observed as to any off-set state so that evaluation was made on the temperature at which an off-set occurred. When the off-set generation temperature was not less than 168° C., the evaluation was ranked as ⊚, when this was in the range from not less than 160° C. to less than 168° C., the evaluation was ranked as ○, when this was in the range from not less than 155° C. to less than 160° C., the evaluation was ranked as Δ (without any problem in practical use), and when this was not less than 55° C., the evaluation was ranked as X (with problems in practical use).

(Anti-blocking properties)

The toner (5 g) was put into a glass tube of 50 cc, and stored at 50° C. for 24 hours. Thereafter, the degree of aggregation of the toner was evaluated. When no aggregation was observed, this case was evaluated as ⊚; when, although toner aggregation was observed, no problem would be raised in practical use, this case was evaluated as ○; and when much aggregation was observed with problems in practical use, this case was evaluated as X.

TABLE 3

| | Kinds of first binder resin | Kinds of second binder resin | Ratio of A:B | Temperature (° C.) at which G' = 2 × $10^3$ (Pa) | Results of evaluation: Appropriate luster generation temperature | Appropriate luster generation temperature width | Fixing lowermost temperature | High-temperature off-set generation temperature | Anti-blocking property |
|---|---|---|---|---|---|---|---|---|---|
| Example 1 | A-1 | B-1 | 80:20 | 98.5 | ⊚ | ⊚ | ⊚ | ⊚ | ⊚ |
| Example 2 | A-1 | B-1 | 60:40 | 103.3 | ○ | ⊚ | ○ | ⊚ | ⊚ |
| Example 3 | A-2 | B-1 | 20:80 | 105.4 | ⊚ | ○ | Δ | ○ | ⊚ |
| Example 4 | A-3 | B-2 | 40:60 | 108.7 | ○ | ⊚ | Δ | ⊚ | ⊚ |
| Example 5 | A-1 | B-3 | 90:10 | 99.5 | ⊚ | ○ | ⊚ | Δ | ⊚ |
| Example 6 | A-2 | B-1 | 75:25 | 91.3 | ⊚ | ○ | ⊚ | Δ | ○ |
| Example 7 | A-1 | B-6 | 80:20 | 106.8 | ○ | ○ | Δ | ⊚ | ⊚ |
| Example 8 | A-1 | B-5 | 70:30 | 95.4 | ⊚ | ○ | Δ | ○ | ○ |
| Example 9 | A-4 | B-1 | 40:60 | 93.6 | ○ | ⊚ | Δ | ⊚ | ○ |
| Example 10 | A-1 | B-1 | 10:90 | 109.1 | Δ | ○ | Δ | ○ | ⊚ |
| Example 11 | A-4 | B-2 | 15:85 | 107.2 | Δ | ○ | Δ | Δ | ⊚ |
| Example 12 | A-5 | B-4 | 15:85 | 109.1 | Δ | ○ | Δ | ○ | ⊚ |
| Comparative Example 1 | A-4 | B-1 | 80:20 | 88.6 | Δ | X | ○ | X | X |
| Comparative Example 2 | A-1 | B-1 | 5:95 | 112.0 | X | ○ | X | ○ | ⊚ |

(Measuring methods in the degree of hydrophobicity)

In the present specification, the degree of hydrophobicity of the externally additive agent was represented by using values obtained as follows:

Pure water (50 ml) was put into a beaker of 200 ml, and to this was added 0.2 g of a sample to be measured, and to this further added methanol dehydrated by using sodium sulfuric anhydride through a buret, while being stirred. Thus, the point at which the sample became virtually invisible on the liquid surface was taken as a terminal point. Based upon the following equation, the degree of hydrophobicity was calculated from the amount of use of methanol (ml).

Degree of hydrophobicity=[Amount of use of methanol/(50+amount of use of methanol)]×100.

The toner of the present invention provides superior effects by which an image having appropriate luster is obtained even when the temperature of the fixing roller is varied or a temperature difference occurs in the fixing roller due to variations in ambient conditions or continuous copying processes for many copies. In other words, even if the temperature of the fixing roller drops due to continuous copying processes, etc., it is possible to obtain images with appropriate luster continuously, and even if a temperature difference occurs in the fixing roller, no variations occur in an image on one sheet. Moreover, it becomes possible to reduce the amount of application of oil to the roller at the time of fixing and also to carry out the fixing process even at low temperatures. Thus, the anti-off-set properties and anti-blocking properties can also be improved.

What is claimed is:

1. A toner for a full color image forming method comprising:

a binder resin comprising a first polyester resin and a second polyester resin, the first polyester resin being a linear polyester resin and the second polyester resin being a non-linear polyester resin, the second polyester resin having a greater weight-average molecular weight than that of the first polyester resin;

a wax in an amount of 0.5 to 7 parts by weight with respect to 100 parts by weight of the binder resin; and a colorant, wherein the toner has a temperature range of 90 to 110° C. at 2×$10^3$ (Pa) of a storage elastic modulus (G') under 0.1 (Hz) of a frequency.

2. The toner of claim 1, wherein said temperature range is from 95 to 110° C.

3. The toner of claim 1, wherein the first binder resin has a number-average molecular weight of 2,000 to 8,000 and a weight-average molecular weight of 7,000 to 30,000, the second binder resin has a number-average molecular weight of 3,000 to 12,000 and a weight-average molecular weight of 30,000 to 250,000.

4. The toner of claim 3, wherein the first binder resin and the second binder resin has a weight ratio (first binder resin:second binder resin) of 20:80 to 95:5.

5. The toner of claim 1, wherein said binder resin has an insoluble content of tetrahydrofuran of not more than 5% by weight.

6. The toner of claim 3, wherein the first binder resin has a number-average molecular weight of 2,500 to 6,000 and a weight-average molecular weight of 8,000 to 25,000, and the second binder resin has a number-average molecular weight of 4,000 to 10,000 and a weight-average molecular weight of 40,000 to 250,000.

7. The toner of claim 6, wherein the first binder resin has a number-average molecular weight of 3,000 to 6,000 and a weight-average molecular weight of 9,000 to 20,000, and the second binder resin has a number-average molecular weight of 4,000 to 7,000 and a weight-average molecular weight of 40,000 to 100,000.

8. The toner of claim 1, wherein the first binder resin has a softening point of 75 to 130° C. and a glass transition point of 45 to 85° C., the second binder resin has a softening point of 105 to 155° C. and a glass transition point of 55 to 85° C.

9. The toner of claim 8, wherein the first binder resin has a softening point of 80 to 125° C. and a glass transition point of 50 to 80° C., the second binder resin having a softening point of 110 to 150° C. and a glass transition point of 60 to 85° C.

10. The toner of claim 9, wherein the first binder resin has a softening point of 85 to 115° C. and a glass transition point of 55 to 75° C., the second binder resin having a softening point of 110 to 145° C. and a glass transition point of 60 to 75° C.

11. A toner for a full color image forming method comprising:

a first polyester resin having a number-average molecular weight of 2,500 to 6,000 and a weight-average molecular weight of 8,000 to 25,000 and a second polyester resin having a number-average molecular weight of 3,000 to 12,000 and a weight-average molecular weight of 30,000 to 250,000, the first polyester resin being a linear polyester resin and the second polyester resin being a non-linear polyester resin;

a wax in an amount of 0.5 to 7 parts by weight with respect to 100 parts by weight of the binder resin; and a colorant, wherein the toner has a temperature range of 90 to 110° C. at $2\times10^3$ (Pa) of a storage elastic modulus (G') under 0.1 (Hz) of a frequency.

12. The toner of claim 11, wherein said temperature range is from 95 to 110° C.

13. The toner of claim 11, wherein the first polyester resin is formed of a divalent acid monomer and a divalent alcohol monomer.

14. The toner of claim 11, wherein the second polyester resin is formed of a divalent acid monomer, a trivalent acid monomer and a divalent alcohol monomer.

15. The toner of claim 11, wherein said binder resin has an insoluble content of tetrahydrofuran of not more than 5% by weight.

16. The toner of claim 15, wherein said insoluble content is virtually 0% by weight.

17. The toner of claim 11, wherein the first polyester resin has a number-average molecular weight of 2,500 to 6,000 and a weight-average molecular weight of 8,000 to 25,000, and the second polyester resin has a number-average molecular weight of 4,000 to 10,000 and a weight-average molecular weight of 40,000 to 250,000.

18. The toner of claim 17, wherein the first polyester resin has a number-average molecular weight of 3,000 to 6,000 and a weight-average molecular weight of 9,000 to 20,000, and the second polyester resin has a number-average molecular weight of 4,000 to 7,000 and a weight-average molecular weight of 40,000 to 100,000.

19. The toner of claim 11, wherein the first polyester resin has a softening point of 75 to 130° C. and a glass transition point of 45 to 85° C., and the second polyester resin has a softening point of 105 to 155° C. and a glass transition point of 55 to 85° C.

20. A color toner for a full color image forming method comprising:

a binder resin comprising a first polyester resin having a number-average molecular weight of 2,500 to 6,000 and a weight-average molecular weight of 8,000 to 25,000, and a second polyester resin having a number-average molecular weight of 3,000 to 12,000 and a weight-average molecular weight of 30,000 to 250,000, the first polyester resin being a linear polyester resin and the second polyester resin being a non-linear polyester resin;

a wax in an amount of 0.5 to 7 parts by weight with respect to 100 parts by weight of the binder resin; and a master-batch colorant having a colorant being dispersed at a rate of 15 to 50 parts by weight with respect to 100 parts by weight of a resin having a compatibility with the binder resin, wherein the toner has a temperature range of from 90 to 110° C. at $2\times10^3$ (Pa) of a storage elastic modulus (G') under 0.1 (Hz) of a frequency.

21. The color toner of claim 20, wherein the first polyester resin is formed of a divalent acid monomer and a divalent alcohol monomer and the second polyester resin is formed of a divalent acid monomer, a trivalent acid monomer and a divalent alcohol monomer.

22. The toner of claim 21, wherein said binder resin has an insoluble content of tetrahydrofuran of not more than 5% by weight.

* * * * *